United States Patent [19]

Rausing

[11] 4,000,325

[45] Dec. 28, 1976

[54] PACKING CONTAINER INTENDED FOR PRESSURIZED CONTENTS

[75] Inventor: Gad A. Rausing, Lund, Sweden

[73] Assignee: Sobrefina SA, Fribourg, Switzerland

[22] Filed: Dec. 10, 1974

[21] Appl. No.: 531,318

[30] Foreign Application Priority Data

Dec. 17, 1973 Switzerland ..... 17636/73

[52] U.S. Cl. ..... 426/111; 222/105; 229/14 BE; 206/530; 206/484; 426/118; 206 525; 426/130

[51] Int. Cl.[2] .....B65D 37/00; B65D 85/72

[58] Field of Search ..... 206/484, 525, 527, 528, 206/530; 222/105, 107; 229/14 BE, 14 BA, 55, 93, 48 T, 57, 14 B; 426/106

[56] References Cited

UNITED STATES PATENTS

| | | | |
|---|---|---|---|
| 2,584,633 | 2/1952 | Southwick, Jr. | 229/55 X |
| 3,106,329 | 10/1963 | Lipschutz | 229/14 BE |
| 3,316,950 | 5/1967 | Fleischer et al. | 229/57 UX |
| 3,516,537 | 6/1970 | Dreyfus et al. | 229/57 UX |

FOREIGN PATENTS OR APPLICATIONS

| | | | |
|---|---|---|---|
| 1,209,426 | 10/1970 | United Kingdom | 229/14 B |

*Primary Examiner*—Steven E. Lipman
*Attorney, Agent, or Firm*—Pierce, Scheffler & Parker

[57] ABSTRACT

In a pressurized packing container having an inner tubular container of plastic material and an outer casing of non-elastic material, which tubular container, after being filled, is to be sealed off along two transverse seals spaced from one another, an improved sealing is realized by causing the transverse seals to have a curved or angled contour at at least one of their end points.

6 Claims, 4 Drawing Figures

PACKING CONTAINER INTENDED FOR PRESSURIZED CONTENTS

Figure 1:
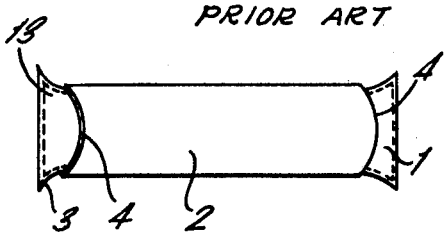
FIG.1. PRIOR ART

The present invention relates to a packing container intended for pressurized contents comprising an inner container of plastic material and a casing or banderole surrounding the inner container of a non-elastic material, e.g. paper, the inner container consisting of a piece of plastic sheet tube which is filled with the contents and which is sealed off along two seals transversing the said tube and being arranged at a distance from one another, the length of the seals exceeding appreciably the distance between the seals and the said seals being located mainly inside the said casing.

In packaging technique frequently packages of plastic material or combinations of plastic material and paper are used for the packing of liquids, e.g. milk, fruit juices or the like. It is also known that pressurized contents, e.g. beer or aerated beverages can be packed in packing containers of relatively thin plastic sheet, but so as to prevent the internal pressure of the contents from giving rise to excessive stresses on the plastic sheet, which can easily be torn up along its sealing joints, the main part of the package is surrounded as a rule by a casing or an envelope of paper or cardboard, which is intended to absorb the stresses in the plastic sheet emanating from the contents. Known packages of the abovementioned type are manufactured as a rule from a tube with a relatively small diameter, which is filled with the pressurized contents and is divided into individual packing units by transverse seals which are arranged at a distance from one another. The plastic packages manufactured in this manner have as a rule to be supported along their central part between the said transverse sealing zones so that the package body should not assume the shape of a bobbin, that is to say become extended in the centre by the internal pressure so that the centre part presents a larger diameter than the end parts. If the packing container is enclosed by a rigid casing which absorbs the pressure from the contents a cylindrical appearance can be imparted to the package body, whilst the parts projecting from the ends of the casing will comprise parts protruding from the extended axial contour of the casing, so-called ears, which are formed by the transverse sealing zones and which occur because of the transverse sealing zone of the tube being longer than the tube diameter. Such protruding parts of the package are not desirable for the transport and handling of the packing containers, since the packing containers cannot be stacked in a rational manner in the collective packages, and they also constitute points of low strength in the construction, since the sealing zones which are not supported by the casing are subjected to stresses which tend to split open the sealing zones.

These disadvantages are overcome in the package in accordance with the invention, in that the transverse joints of the tube are not, or are only to a small part, exposed at the end openings of the outer casing, but are instead covered by the outer casing, whilst the parts of the tube which do project from, or are exposed at, the end openings of the casing, do not have any sealing joint. It is a further characteristic of the invention that the said transverse seals, close to at least one of their end points, present a curved contour with the object of imparting to the part or parts of the inner container projecting from the end openings of the casing a rounded or dome-shaped appearance, and that the said projecting parts of the inner container do not protrude sideways from the contour of the axial extension of the casing.

Figure 2:
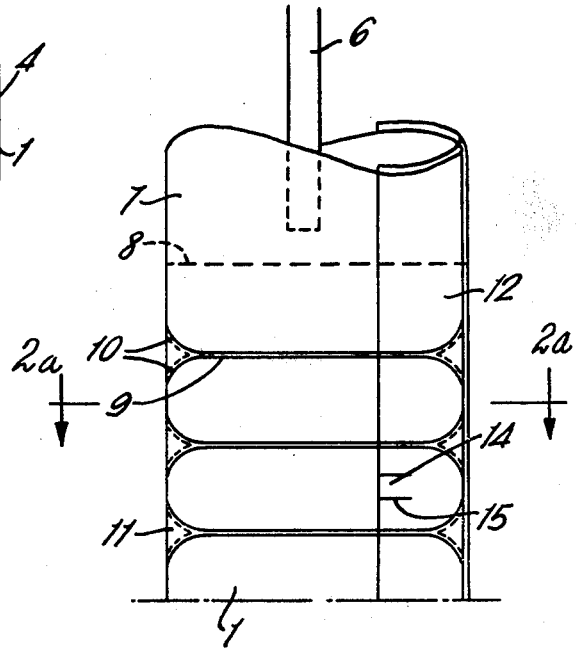
Figure 2A:
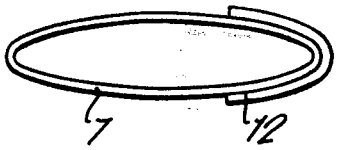
Figure 3:
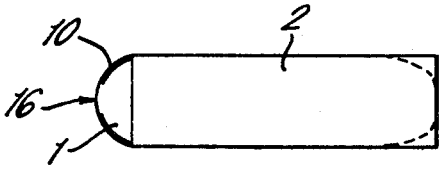

In the following the invention will be described with reference to the enclosed schematic drawing, in which FIG. 1 shows a packing container of known type, FIG. 2 shows a side view of a tube from which packing containers in accordance with the invention are manufactured, FIG. 2*a* shows a cross-section through the tube, as shown in FIG. 2, and FIG. 3 shows a side elevation of the finished package in accordance with the invention.

The packing container of known type shown in FIG. 1 consists of an inner plastic container 1 of thin plastic sheet and outer casing 2, which surrounds the central part of the inner container 1. The inner container 1 is manufactured from a tube which either can be manufactured so that it has no longitudinal seam, or else may be made from a web by joining together the edges of the web in a longitudinal joint. Since the packing container is intended for pressurized contents of the type of beer or aerated beverages, it is necessary that the packing material should be relatively impervious to gas and moreover that its mechanical strength characteristics should be such, that the packing material is capable of absorbing the stresses which emanate from the pressurized contents. As mentioned earlier the inner container is manufactured from a tube which is filled with the contents and is sealed off along narrow end sealing zones 3 situated at a distance from one another, which sealing zones have a length which is greater than the diameter of the remaining part of the inner container 1 to which, owing to the internal pressure, is imparted a circular-cylindrical shape. The outer casing 2, which e.g. may be constituted of a banderole of strong paper material, absorbs the stresses which otherwise would give rise to a deformation of that part of the inner plastic container 1 which is situated inside the casing 2, and since the casing 2 is made of a basically non-elastic material, the stresses do not give rise to any deformation of the casing 2, but the central part of the packing container obtains a well-defined shape and which is the same for all packing containers. The parts of the inner container 1 exposed at the end openings 4 of the casing, however, present protruding parts 13, so-called ears, which protrude from the extended axial contour of the casing. Furthermore the sealing joints 3, by means of which the tube is divided into individual packing containers 1, are not supported by the outer casing 2 so that the pressure inside the inner container part 1 can easily give rise to the sealing joint 3 being burst open if the packing container is stored at elevated temperature, if it is exposed to external pressure or if in some other manner the internal pressure in the packing container 1 is raised.

The tube 7 shown in FIG. 2 has for the same package size as the package shown in FIG. 1 an appreciably greater diameter, and in principle the width of the tube 7 laid flat corresponds to the length of the final package. The tube 7 is filled with the help of a filler pipe 6 with the intended pressurized contents 8, whereupon the tube 7 is divided by means of a sealing device, not shown here, into individual packing units by means of repeated transverse seals 9. As can be seen from FIG. 2 the transverse sealing zones 9 at their ends 10 are formed with curved parts, diverging from one another, and the area 11 between the diverging sealing zones 10 may be punched out if desired. After filling and transverse sealing of the tube 7, the individual containers 1 are separated by cutting through the transverse sealing zones 9, whereupon the separated containers 1 filled with pressurized contents are put into a casing 2 or are envelopped or wrapped in a material, e.g. paper, which may be laminated with metal foil or coated with plastic material. As the filling and encasing or wrapping operations take place whilst the contents are at a low temperature, the pressure within the container 1 has not had time to be increased to such an extent as to inflate the walls of the container to such a degree as to prevent the placing of the container into the casing. As the material 11 in the area between the diverging sealing zones 10 does not have any function, it is appropriate to punch out the material within this area.

As mentioned earlier, the parts of the inner plastic container 1 which protrude from the end openings of the casing 2 are subjected to greater mechanical stresses than the parts which are surrounded by the casing 2. Even if the main part of the sealing joints 9 is inside the casing 2 it is still unavoidable that some parts of the seal, in the case described here the curved seals 10, will be situated outside the casing 2. So as to strengthen the parts of the inner container 1 situated outside the casing 2, it is possible to manufacture the tube 7 in such a manner that certain parts, and in this case the parts which are ultimately intended to form the portion of the inner container situated outside the casing 2, are made thicker than the remaining part of the tube 7. This may be done during the extrusion of the tube, but it is also possible, in the manner as shown in FIG. 2*a*, to laminate the tube 7 subsequently with a reinforcement foil 12 or else to fit a reinforcement foil 12 over one side of the tube in such a manner that the reinforcement foil 12 together with the tube 7 is sealed along the transverse sealing zones 9, the tube material and the reinforcement foil 12 being joined together along the common sealing zones. The reinforcement foil 12 may be fitted on both ends of the inner container 1 or only on the one end, and it is possible to combine the reinforcement foil 12 with an opening device which e.g. operates in such a manner that a part 14 of the reinforcement foil 12, which is formed by cuts or incisions 15, is sealed over a pouring hole provided in the tube 7, which pouring hole can be laid free when the lug 14 is torn open, or else that the lug 14 is sealed so firmly to the tube material 7 that the latter is torn up in the area about the lug 14 when the latter is gripped with the fingers and pulled outwards. So as to provide a good pulling grip it is suitable to adapt the reinforcement foil 12 so that its edge portion has an unsealed zone against the tube 7. The reinforcement foil 12 may suitably consist of plastic sheet or aluminium foil or else of paper.

In FIG. 3 is shown the finished packing container, which consists of the outer casing 2, which tightly surrounds the inner container 1, in which is placed the pressurized material. From one end of the casing 2 projects a part 16 of the inner container 1, but owing to the sealing lines 10 having been made curved, the projecting part 16 will have a rounded or dome-shaped appearance, and does not protrude outside the axial extension of the casing 2. This effect can also be achieved if the sealing lines 10 instead of a curved contour are given an angled contour in relation to the sealing line 9, but in such a case greater tensile stresses in the packing material will arise in the part 16 of the inner container projecting from the casing 2 than if the sealing line 10 is given a rounded or curved contour, since the pressurized contents endeavour to shape the projecting part 16 to an hemisphere, and the tensile stresses arising in the packing material will be less, the better the sealing lines 10 are adapted to the hemispherical shape aimed at, which, however, can never be wholly achieved.

In view of the character of the contents, the packing material of the inner container 1 has to be very impervious to gas, on the one hand so as to prevent the pressure gas, which in most cases is carbon dioxide, from diffusing out through the walls of the package on the other hand so as to prevent oxygen gas from diffusing into the package, which owing to the oxidizing effect of oxygen would be detrimental to the flavouring matter of e.g. beer. In order to achieve the desired properties of imperviousness to gas a number of plastic sheets or plastic laminates occurring on the market may be used, and the essential factor for the invention is not which of these materials is used but only that the material which is used should be heat-sealable and have sufficiently good properties of strength and of imperviousness to gas.

I claim:

1. A package container for pressurized contents comprising an inner elongated container composed of plastic material and an outer sleeve-like casing of non-elastic material, said inner plastic container having two opposed longitudinal seals formed when forming said package by filling a tube of said plastic material with the contents and subsequently forming seals transversely of said tube at spaced intervals therealong to form consecutive plastic containers and separating said containers by cutting through said transverse seals, consecutive transverse seals constituting the longitudinal seals of the separate inner plastic containers, at least one of the ends of each transverse seal being branched divergently away from the line of the transverse seal to form a substantially hemispherical configuration at at least one end of said inner plastic container, said at least one hemispherical end of said inner container extending beyond said casing.

2. A package container as claimed in claim 1 wherein the at least one branched divergent end of the transverse seal has straight, diverging lines.

3. A package container as claimed in claim 1 wherein the at least one branched divergent end of the transverse seal has curved, diverging lines.

4. A package container as claimed in claim 1 wherein the plastic material between the diverging lines of the at least one branched divergent end of the transverse seal is removed to provide the substantially hemispherical configuration of the at least one end of the inner plastic container.

5. A package container as claimed in claim 1 wherein both ends of each transverse seal is branched divergently away from the line of the transverse seal to form substantially hemispherical configurations at both ends of said inner plastic container.

6. A package container as claimed in claim 5 wherein said sleeve-like casing encloses one end of said plastic inner container and the other end thereof extends beyond said casing.

* * * * *